US005758245A

United States Patent [19]

Matsuura et al.

[11] Patent Number: 5,758,245

[45] Date of Patent: May 26, 1998

[54] FIXING DEVICE FOR AN IMAGE FORMING APPARATUS

[75] Inventors: Masahiko Matsuura, Suita; Atsuto Hirai, Ikoma; Takashi Kondo, Sakai, all of Japan

[73] Assignee: Minolta Co., Ltd., Osaka, Japan

[21] Appl. No.: 811,458

[22] Filed: Mar. 3, 1997

[30] Foreign Application Priority Data

Mar. 4, 1996 [JP] Japan ..... 8-046038
Jan. 9, 1997 [JP] Japan ..... 9-001889

[51] Int. Cl.[6] ..... G03G 15/20

[52] U.S. Cl. ..... 399/329; 219/216; 399/335

[58] Field of Search ..... 399/329, 330, 399/331, 335, 336, 328; 219/216, 388, 469

[56] References Cited

U.S. PATENT DOCUMENTS

| | | | |
|---|---|---|---|
| 4,242,566 | 12/1980 | Schribner | 219/216 |
| 4,243,869 | 1/1981 | Schribner | 219/216 |
| 4,973,824 | 11/1990 | Ohashi et al. | 219/216 |
| 5,250,998 | 10/1993 | Ueda | 219/216 X |
| 5,268,559 | 12/1993 | Jacobs | 219/216 |
| 5,349,424 | 9/1994 | Dalal et al. | 219/216 X |
| 5,359,401 | 10/1994 | Uehara et al. | 219/216 X |
| 5,410,394 | 4/1995 | Wayman et al. | 219/216 X |
| 5,436,710 | 7/1995 | Uchiyama | 355/285 |

FOREIGN PATENT DOCUMENTS

| | | |
|---|---|---|
| 1-85857 | 6/1989 | Japan . |
| 5-072926 | 3/1993 | Japan . |
| 5-127551 | 5/1993 | Japan . |

*Primary Examiner*—R. L. Moses
*Attorney, Agent, or Firm*—McDermott, Will & Emery

[57] ABSTRACT

A fixing device (20) for heating and then fixing an unfused toner image onto a sheet substrate includes a first roller (24) and a second roller (28) spaced apart from the first roller. A third roller (26) is arranged between the first and second rollers. A portion of the third roller is protruded across an imaginary line (38) which contacts with outer peripheries of the first and second rollers on the same side thereof into a region (40) in which the first and second rollers are located. A fourth roller (30) is spaced apart from the third roller beyond the first or second roller. A portion of the fourth roller is also protruded across the imaginary line into the region. A heater (36) is mounted for heating the rollers. The sheet (22) is transported with one surface thereof contacted with the first and second rollers while the other surface thereof is contacted with the third and fourth rollers along a sheet path (42) defined by peripheral portions of the four rollers.

12 Claims, 4 Drawing Sheets

FIXING DEVICE FOR AN IMAGE FORMING APPARATUS

FIELD OF THE INVENTION

The invention relates to a fixing device for use in an electrophotographic image forming apparatus, such as copy machine, printer, and facsimile. More especially, the invention relates to a fixing device for heating and then fixing a toner image onto a sheet substrate.

BACKGROUND OF THE INVENTION

Generally, in an electrophotographic image forming device, such as, copy machine and printer, a toner image formed on an electrostatic latent image bearing member (e.g., photosensitive member) is transferred onto a sheet substrate by a transfer device and then heated to fix onto the sheet substrate permanently by a fixing device.

For this purpose, conventionally two types of fixing devices have been provided, i.e., a contact fixing device and a non-contact fixing device. The contact fixing device applies a certain pressure on the sheet and the toner image supported on the sheet while heating. The non-contact fixing device fixes the toner on the sheet without applying such pressure. These contact and non-contact fixing devices have respective advantages and disadvantages.

The contact fixing device includes a heat roller fixing device. The heat roller fixing device has a heat roller to be heated by a heater incorporated therein and a pressure roller in circumferential contact with the heat roller, by which the unfused toner image, together with the sheet, is heated under pressure while moving past a contact (i.e., nipping) region of the rollers and thereby fixed on the sheet. This fixing process is advantageous that the toner image is firmly fixed on the sheet due to the pressure and the sheet as well is directly heated to result in an efficient heating of the toner image. This, in turn, results in an economical fixing with a decreased power consumption, allows the process to be suitably used in a high speed image forming apparatus, and permits the fixing device to be small sized.

This contact fixing device, however, tends to flatten the toner image due to the pressure applied. To overcome this problem, the heat roller may be constructed of a cylindrical metal member having a heat source therein and an elastic layer coated on an outer peripheral surface of the cylindrical metal member so as to reduce the pressure applied to the toner image. This, however, may cancel the advantages of the contact fixing device because of decreased heat conductivity of the elastic layer which will reduce an efficiency of heating for both the toner image and the sheet. There also exists another disadvantage that a requirement for heating the cylindrical metal member to an elevated temperature will result in a reduction of durabilities of the cylindrical metal member. Further, in case of feeding a continuous sheet (i.e., a web of sheet) rather than individual sheets (i.e., cut sheet) having distinct sizes (e.g., A4 size), an increased tension is provided therewith, which results in a transverse movement of the continuous sheet. Thereby, an additional mechanism should be provided for correcting the transverse movement of the sheet or preventing the sheet from moving transversely.

The non-contact fixing device, on the other hand, includes a flashlight fixing device. The flashlight fixing device has a flashlight and a reflector. With this flash fixing device, a flashed light from the flashlight is reflected by the reflector and then projected on the toner image on the sheet, thereby the toner image is fused onto the sheet. This fixing device has no elements which brings into contact with the toner image or the sheet and therefore has no problems, such as, flattening of toner image or wearing of the heat source. However, the fixing device presents a reduced heat efficiency compared to the heat roller. Thus, the fixing device requires the flashlight to be large-sized and is unsuitable for a high speed image forming device. Also, a surface of the fixed toner image is kept uneven, which reduces a glossiness of the resultant image. Further, the heat source should be kept at an elevated temperature and therefore the sheet can be damaged by its heat when it has jammed to bring into contact therewith. Furthermore, the cut sheet can be curled as the melted toner coagulates.

To overcome the above described disadvantages of the flashlight fixing device, Japanese Patent Laid-Open Publication No.6-301304 discloses a fixing device in which a light from a plurality of light emitting diodes set in array is focused by a cylindrical lens onto a sheet to heat and then fix the toner image onto the sheet. This device is improved in heat efficiency over the flashlight fixing device, however, it still needs the heat source of elevated temperature, which may be an essential and unsolved problem of the non-contact fixing device.

Also included in the contact fixing device is a belt fixing device. Japanese Patent Laid-Open Publications Nos. 5-72926, and 5-127551, and Japanese Utility Model Laid-Open Publication No. 1-84847 disclose a twin-belt fixing device which includes a pair of belt mechanism. In this twin-belt fixing device, each belt mechanism has an endless belt and a pair of rollers for supporting the belt. Also, the rollers in one belt mechanism are forced on corresponding rollers in the other belt mechanism via belts, and a heater is arranged inside at least one of the belts. With this arrangement, the two belts rotate in opposite directions by a motor so that they travel in the same direction at an extended contact region thereof while being heated by the heater. Then, when the toner image, together with the sheet, is nipped in the contact region by the heated belts, it is heated and then fixed onto the sheet.

As described above, the twin-belt fixing device has the extended contact region and therefore allows the toner image and the sheet to be sufficiently heated. Thus, the device is suitably employed in the high speed image forming apparatus and a multi-color image forming device in which a plurality of toner images are superimposed to form a multi-layered color image.

In the twin-belt fixing device, however, the sheet is pressure nipped by the opposing rollers, like heat roller fixing device, which results in the flattening of the toner image. Also, the transverse movement of the belt can not be readily corrected. Further, if an increased tension is applied to the belt for correcting the transverse movement, unwanted wrinkles may created in the belt. Furthermore, a belt portion between adjacent rollers, i.e., in the contact region, is not stretched sufficiently, which reduces adhesions of between one belt and the opposing belt and in turn between the belts and the sheet.

SUMMARY OF THE INVENTION

Accordingly, an object of the invention is to provide a new fixing device having advantages of both contact fixing device and non-contact fixing device.

Another object of the invention is to provide an improved twin-belt fixing device free from the above described disadvantages.

For these purposes, a fixing device of the present invention includes a first roller, a second roller spaced apart from the first roller, a third roller arranged between the first and second rollers with a portion of thereof protruded across an imaginary line which contacts with outer peripheries of the first and second rollers on the same side thereof into a region in which the first and second rollers are located, and a heat source for heating at least one of the four rollers. In this fixing device, the sheet is transported with one surface thereof contacted with the first and second rollers while the other surface thereof contacted with the third roller along a sheet path defined by peripheral portions of the four rollers.

A fourth roller may be arranged which is spaced apart from the third roller beyond the first or second roller with a portion thereof protruded across the imaginary line into the region.

More preferably, the fixing device further includes a device which controls the amount of protrusions of the third and fourth rollers across the imaginary line.

With this arrangement, the first and second rollers are kept away from the third roller. Then, no excessive pressure is applied on the toner image as well as the sheet supported and transported by the rollers. As a result, the toner image is hardly flattened, which ensures a high quality resultant image. Also, no excessive bending force is applied on a cylindrical metal member of each roller, which permits the use of economical rollers.

Further, a roller capable of emitting an increased heat energy from its surface can be used as the roller. This results in a rapid heating of the roller with an reduced energy, which allows the fixing device of the invention to be used in the high speed image forming device.

Furthermore, a transverse movement of the sheet can be reduced significantly. Also, if occurred, the transverse movement can readily be eliminated with a device having a simple construction.

Moreover, an extended contact region can be formed between the rollers and the sheet. This permits the use of metal roller which has a greater heat conductivity and more economical than a roller in which an outer periphery thereof is covered with an elastic material, such as, rubber.

Further, a sufficient heat for fixing can be provided with the toner image from a plurality of rollers even if temperatures of the rollers are relatively low, which reduces the power consumption of the rollers.

Furthermore, it is not necessary to apply a release material with the member to be contacted with the toner image to prevent the toner from transferring to the member.

Moreover, the toner image can fully be fixed on the sheet to be transported at a relatively high speed.

Further, with the device for controlling the protrusion of the roller, a time in which the toner will contact with the roller (i.e., a time for heating) can be controlled depending upon fixing factors, such as, thickness of the sheet.

In another aspect of the invention, a fixing device of the invention includes a first endless belt rotatably supported about a first and a second rollers, a second endless belt rotatably supported about a third and a fourth rollers in circumferential contact with the first belt to form a sheet path therebetween. The third roller is arranged between the first and second rollers. Also, the fourth roller is spaced apart from the third roller beyond the first or second roller. The fixing device further includes a heat source for heating at least one of the first and second belt. In this fixing device, the sheet is transported with one surface thereof contacted with the first belt and with the other surface thereof contacted with the second belt along the sheet path.

With this arrangement, the belt is forced inwardly by the roller which supports the other belt and thereby brought in close contact to the other belt. Also, the rollers which support respective belts are spaced apart from each other. Therefore, no excessive pressure is applied on the opposing or contact region of the belts. Therefore, no excessive pressure is applied on the toner image in the contact region, which results in a high quality image free from flattening. Also, the transverse movement of the belt can easily corrected by applying a slight force on the belt without creating wrinkles in the belt.

BRIEF DESCRIPTION OF THE DRAWINGS

These and other objects and features of the present invention will become clear from the following description taken in conjunction with the preferred embodiments thereof with reference to the accompanying drawings throughout which like parts are designated by like reference numerals, and in which.

PREFERRED EMBODIMENT OF THE INVENTION

Figure 1:
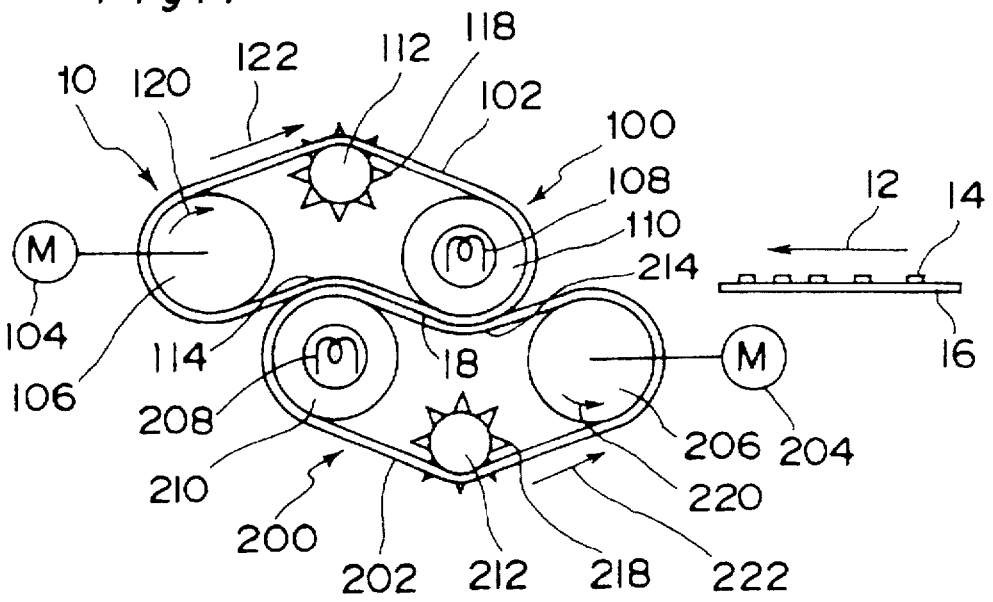
FIG. 1 is a side elevational view of a fixing device of a first embodiment according to the invention.

With reference to the drawings, particularly in FIG. 1, a twin-belt fixing device 10 of the invention is depicted. Generally, the fixing device 10 has a first belt mechanism, or upper belt mechanism 100, and a second belt mechanism, or lower belt mechanism 200. The upper belt mechanism 100 includes an endless fixing belt 102. The belt 102 is supported about a drive roller 106 drivingly connected with a motor 104, a heat roller 110 having therein a heater 108, and a tension roller 112. Likewise, the lower belt mechanism 200 includes an endless fixing belt 202 similar to the endless belt 102 in the first belt mechanism 100. The belt 202 is supported about a drive roller 206 drivingly connected with a motor 204, a heat roller 210 having therein a heater 208, and a tension roller 212. Preferably, each of the belts 102 and 202 is a thin belt of silicone rubber or metal (e.g., nickel), having an increased heat conductivity. More preferably, an outer peripheral surface of the belt is coated with a release material of, such as, polytetrafluoroethylene or silicone rubber. Advantageously, the belt may be of a heat resisting resin (e.g., polyimid), the outer periphery thereof being coated with the release material.

The two belt mechanisms 100 and 200 are so assembled, as shown in FIG. 1, that a belt portion 114 of the first belt 102 extending between the drive roller 106 and the heat roller 110 is forced inwardly by the heat roller 210 and a belt portion 214 supported thereby and extended between the heat roller 210 and the drive roller 206. Thereby, the belt portions 114 and 214 face in close contact with each other at between the heat rollers 110 and 210 to form a sine-curve like sheet path, i.e., nipping region 18.

Figure 2:
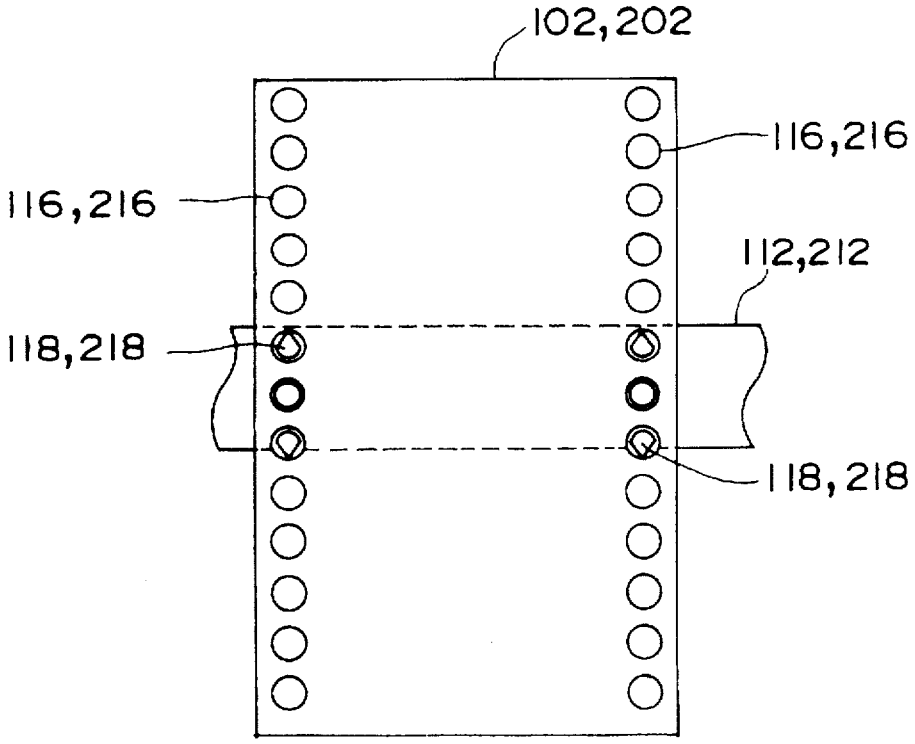
FIG. 2 is a partial plan view of the fixing device shown in FIG. 1, which illustrates protrusions on the roller engaging perforations in a continuous sheet.

Referring to FIG. 2, the fixing belt 102 and 202 have therein a number of perforations 116 and 216 at even intervals along opposite circumferential edges thereof, respectively. The tension rollers 112 and 212 have associated sprockets 118 and 218 at their corresponding end portions which engage the perforations 116 and 216, respectively.

In the operation of the fixing device 10 so constructed, upon energizing the motors 104 and 204 in respective belt mechanisms 100 and 200, the drive roller 106 rotates in the direction indicated by arrow 120 while the drive roller 206 rotates in the reverse direction indicated by arrow 220 at the same rate. This permits the belts 102 and 202 to rotate in the respective directions 122 and 222 at the same rate, which in turn rotates the heat rollers 110 and 210 and the tension rollers 112 and 212. Also, by applying an electric power to the heaters 108 and 208, the heaters 108 and 208 heat the heat rollers 110 and 210, respectively, thereby heating the fixing belts 102 and 202.

As shown in FIG. 1, a sheet 16 supporting an unfused toner image 14 is advanced in the direction indicated by arrow 12 into the sheet path, i.e., nipping region 18, defined by the contact surfaces of the fixing belts 102 and 202. The sheet 16 with the toner image 14 is heated by the upper and lower fixing belts 102 and 202. As a result, the toner image 14 is fused and fixed onto the sheet 16 due to a contact force between the fixing belts 102 and 202. Afterwards, the sheet 14 on which the toner image 14 has fixed is discharged from the nipping region 18 by the rotations of the fixing belts 102 and 202.

In this arrangement, neither of the fixing belts 102 nor 202 is nipped between opposing rollers. Therefore, no fused toner image is flattened which could occurred in the conventional twin-belt fixing device as described above, which results in a high quality image.

Also, in this arrangement, the sprockets 118 and 218 on the tension rollers 112 and 212 engage associated perforations 116 and 216 of the fixing belts 102 and 202, respectively. This automatically eliminates possible transverse movement of the fixing belts 102 and 202 which should otherwise be corrected by, for example, inclining one or more the belt support rollers. This automatic correction of the transverse movement of the belt is effectively performed because the belts 102 and 202 are not tightly held in the nipping region 18. In addition, no wrinkle is formed with the belts 102 and 202 in the nipping region 18 as well as in other regions. Likewise, if the sheet 16 is a web, or continuous sheet, the web will hardly move transversely in the nipping region 18. Besides, each of the belt portions 114 and 214 forming the nipping region 18 is forced in close contact with each other due to the pressure applied by the heat rollers 110 and 210, which allows the heat of the fixing belts 102 and 202 to be efficiently transmitted to the toner image 14 and the sheet 16, ensuring an effective heating and fusing of the toner image 14.

Figure 3:
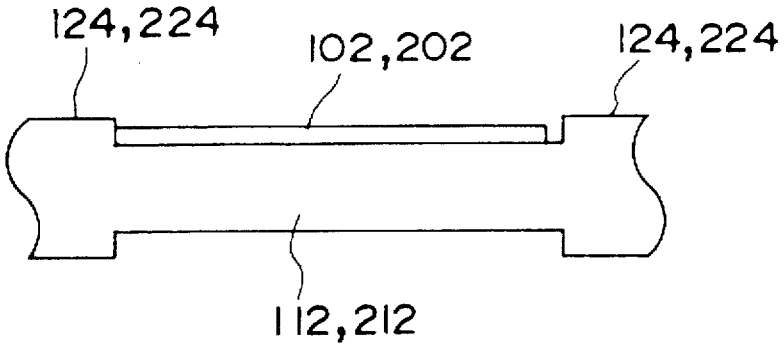
FIG. 3 is a partial front view of a tension roller having side walls on opposite ends.
Figure 4:
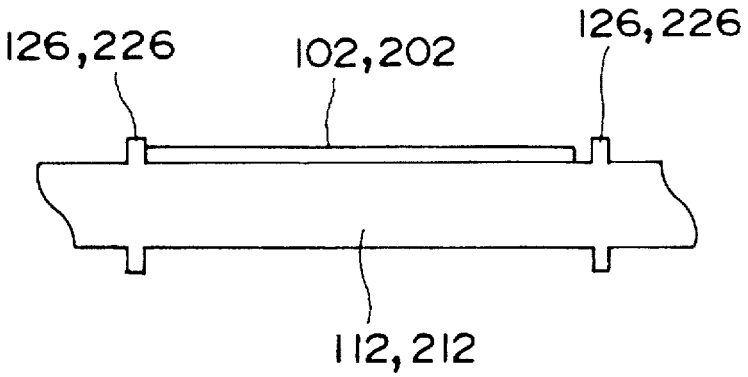
FIG. 4 is a partial front view of another tension roller having side walls on opposite ends, the side walls being different from those of shown in FIG. 3.

Although, in the previous embodiment, the transverse movement is eliminated by engaging the sprockets 118 and 218 formed on the tension rollers 112 and 212 with the perforations 116 and 216 defined in the fixing belts 102 and 202, as shown in FIGS. 3 and 4 the tension rollers 112 may be provided at its opposite peripheral end portions with respective walls 124 and 224 while the tension roller 212 with respective walls 126 and 226 and thereby allow the fixing belts 102 and 202 to correct respective transverse movements by themselves.

Figure 5:
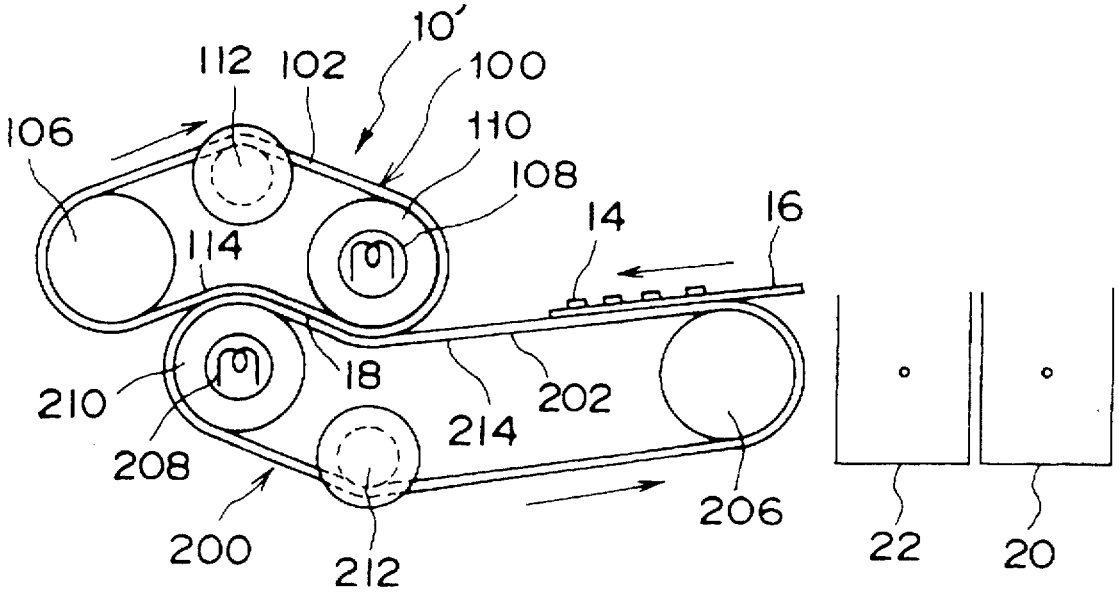
FIG. 5 is a side elevational view of a fixing device of the second embodiment according to the invention.

FIG. 5 shows a modified fixing device 10' in which the drive roller 206 of the lower belt mechanism 200 is located adjacent both a transfer device, or transfer charger 20, for transferring the unfused toner image from an image bearing member such as photoreceptor (not shown) onto the sheet and a detaching device, or detaching charger 22, for detaching the sheet from the image bearing member, so that the sheet 16 detached from the image bearing member is transported into the nipping region 18 by the lower belt mechanism 200. In this instance, no extra transporting means is required for feeding the sheet from where the transfer device confronts the image bearing member to the nipping region. Further, with this arrangement, since the fixing belt 202 is heated by the heat roller 210, the sheet 16 and the unfused toner image 14 can be pre-heated by the contact with the fixing belt 202 before entering into the nipping region 18, which in turn reduces a power and energy consumption of the heater 108.

Figure 6:
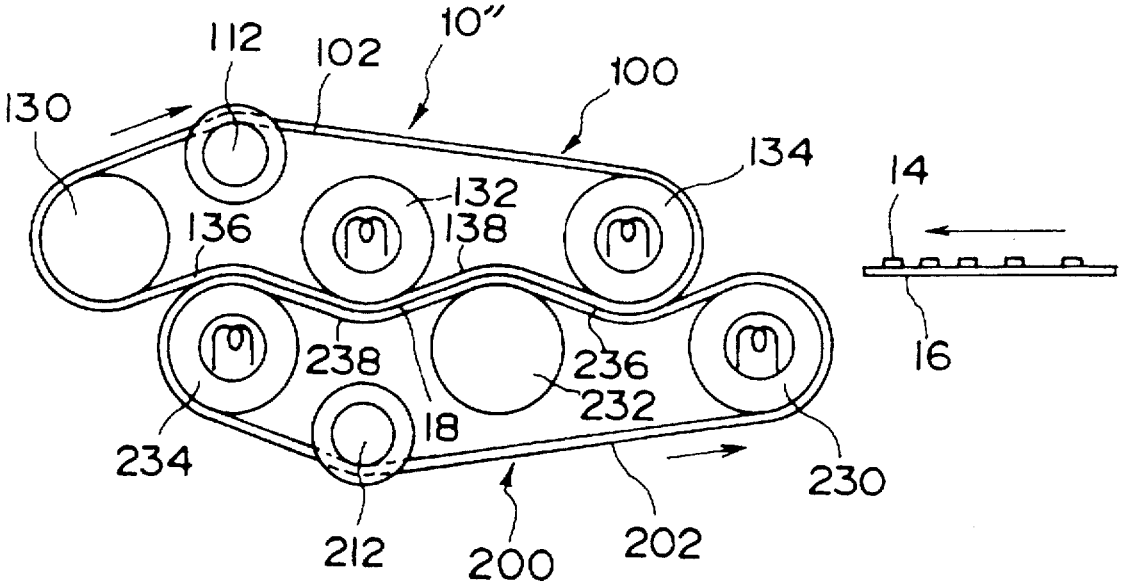
FIG. 6 is a side elevational view of a fixing device of the third embodiment according to the invention.

FIG. 6 shows another modified fixing device 10" in which the upper belt mechanism 100 includes three rollers 130, 132, and 134 adjacent the lower belt mechanism 200 while the lower belt mechanism 200 includes three rollers 230, 232, and 234 adjacent the upper belt mechanism 100 so that the belt portions 136 and 138 between the rollers 130 and 132, and 132 and 134 in the upper belt mechanism 100 are forced inwardly by the respective confronting rollers 234 and 232 in the lower belt mechanism 200 while the belt portions 236 and 238 between the rollers 230 and 232, and 232 and 234 are forced inwardly by the respective confronting rollers 134 and 132 in the upper belt mechanism 100. With this arrangement, the nipping region 18 is significantly extended in the sheet moving direction, which allows the toner image 14 to be fused and fixed on the sheet 16 in an extended period of time. Further, this facilitates an arrangement of the heat rollers and the heaters. Furthermore, the number of the rollers to be heated and the heaters to be energized can be determined depending upon the types of toners and sheets to be used and a amount of toner particles to be deposited on the sheet. Also, the electric power to be applied to the heaters can be reduced providing that the toner image can fully be fused on the sheet.

It should be appreciated that, although the heaters are incorporated in the rollers 132, 134, 230, and 234, the heater may be incorporated in any of the rollers and not limited thereto.

Further, although each belt mechanism includes three rollers adjacent the opposite belt mechanism, the number of which is not limited thereto and more rollers may be arranged in each belt mechanism.

Furthermore, in each belt mechanism, any roller may be drivingly connected to the motor and not limited to the embodiment.

Moreover, although the above describes the fixing process in which the toner image 14 is fixed on one, or upper, surface of the sheet 16, the fixing device may also be used for fixing toner image on opposite surfaces of the sheet. In this instance, each of the belts 102 and 202 is preferably provided at its outer peripheral surface with a release coating layer.

In addition, if the fixing belt 102 adjacent the toner image is covered at its outer periphery by silicone rubber while the fixing belt 202 away from the toner image is made of metal, an even heat distribution is established in the nipping region because of an elevated heat conductivity of the metal. Also, the fixing belt tends to cause a temperature gradient therein and to increase its temperature where the sheet does not contact therewith, though, these problems can be solved by the use of the metal belt. It should be noted that only the belt being kept away from the toner image can be the metal belt because the toner image will be overheated by the contact with the metal belt, degrading the quality of a resultant image.

Figure 7:
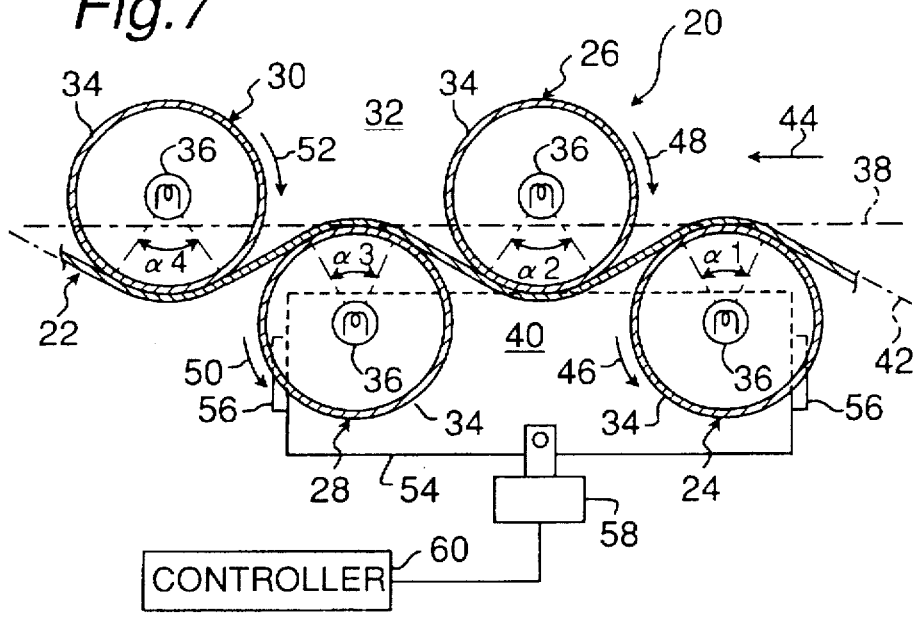
FIG. 7 is a side elevational view of a fixing device of the fourth embodiment according to the invention.

FIG. 7 shows a fixing device 20 which is suitably utilized in a toner fixing for a continuous sheet. The fixing device 20 includes four rollers; a first lower roller 24, a first upper roller 26, a second lower roller 28, and a second upper roller 30. These rollers are arrayed in zigzag with respect to a direction indicated by the arrow 44 along which a continuous sheet 22, or web, is transported. Each of the rollers 24, 26, 28, and 30 has a rotatably mounted cylindrical member 34 and a heat source or heater 36 incorporated therein. When considered a heat conductivity from the roller to the sheet, no coating is preferably provided on an outer periphery of the cylindrical metal member 34, though, to prevent the toner from adhering on the roller, the outer peripheral surface of the cylindrical metal member 34 may be covered with a release material of, such as, polytetrafluoroethylene or with a heat resisting material of, such as, silicone rubber or fluorine-contained rubber.

The upper rollers 26 and 30 are so arranged that lowermost portions thereof protrude downward into a region 40 across a tangential line 38 which connects uppermost portions of the lower rollers 24 and 28, thereby forming a sheet path 42 in the form of sine-curve along which the sheet 22 is transported with its upper surface contacted with the upper rollers 26 and 30 and its lower surface with the lower rollers 24 and 28.

Figure 8:
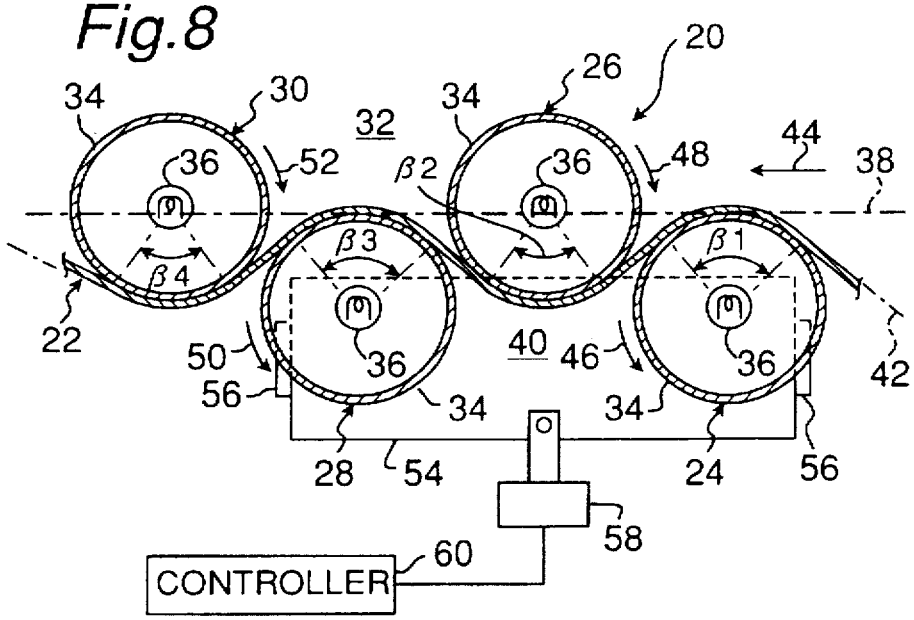
FIG. 8 is a side elevational view of the fixing device shown in FIG. 7, in which lower rollers are in an elevated position.

The upper rollers 26 and 30 are supported at opposite ends thereof by opposing side walls 32 (one of which being not shown). The lower rollers 24 and 28, on the other hand, are supported at opposite ends thereof by opposing frames 54 (one of which being not shown). The frame 54, which is preferably rectangular in shape, is mounted on an inside surface of the corresponding side wall 32. Also, the frame 54 is guided at its side edges extending substantially vertically by opposing guides 56 adjacent thereto so that it can move only vertically. Each frame 54 is mechanically connected with a solenoid 58 supported on the side wall 32 so that it can move between a lowered position shown in FIG. 7 and an elevated position as shown in FIG. 8.

In operation of the fixing device 20 so constructed, the continuous sheet 22 is positioned and fed along the sheet path 42 with its upper surface contacted with the upper rollers 26 and 30 and its lower surface contacted with the lower rollers 24 and 28 substantially in the direction indicated by arrow 44. Also, the continuous sheet 22 is stretched by a sheet feeding device no shown in its longitudinal feeding direction, thereby it is forced on the outer peripheral surfaces of the rollers 24, 26, 28, and 30 at respective contact regions therewith. This in turn causes friction forces between the continuous sheet 22 and the rollers 24, 26, 28, and 30, which allows these rollers to rotate in the directions indicated by respective arrows 46, 48, 50, and 52. The heaters 36 on the other hand are applied with certain voltages, thereby associated rollers 24, 26, 28, and 30 are heated to a certain elevated temperature. As a result, the toner images supported on either or both of the upper and lower surfaces of the sheet 22 are heated at the contact regions with the rollers 24, 26, 28, and 30 and then fixed on the sheet 22.

As described, the toner image is heated by the contact with the plurality of rollers 24, 26, 28, and 30, and therefore it can be fully melted and then fixed on the sheet 22, even when the rollers are heated up to a relatively low temperature, e.g., at a temperature where the toner begins to melt, i.e., about 100°–120° C. Therefore, no toner is heated excessively, which prevents the toner from being heated to an extremely elevated temperature that causes a portion of the toner to transfer onto the roller where the sheet begins to separate therefrom. Also, the sheet 22 is heated at its opposite surfaces equally and therefore the toner images supported on the surfaces can suitably be fixed thereon and provided with same glossiness.

It is necessary in certain cases to increase the heat energy to be supplied with the continuous sheet 22, in which, for example, a different continuous sheet is to be fed having a greater thickness than that of the previous one, or the toner image to be fixed on the sheet is changed from the one formed of one layer, i.e., single color image, to the one formed of multi-layers, i.e., multi-color image. In these case, as shown in FIG. 8, the solenoid 58 is energized so that the frame 54 with the lower rollers 24 and 28 is moved to the elevated position. Thereby, contact angles, or contact length, of respective rollers 24, 26, 28, and 30 against the sheet 22 are changed from $\alpha 1$, $\alpha 2$, $\alpha 3$, $\alpha 4$, and $\alpha 4$ (see in FIG. 7) to $\beta 1$, $\beta 2$, $\beta 3$, and $\beta 4$ (see FIG. 8) greater than $\alpha 1$, $\alpha 2$, $\alpha 3$, and $\alpha 4$, respectively, which permits a rapid increasing of the heat energy to be supplied to the continuous sheet 22. Preferably, the solenoid 58 is electrically connected with a controller 60 so that it can be energized or de-energized according to information fed to the controller 60 by manual or automatic operations. Such information may be the one indicating that the sheet to be fed has a thickness of greater or less than the previous one or that the toner image to be fixed is a single color or a multi-color.

The mechanism for moving the lower rollers from the elevated position to the lowered position and vice versa is not limited to the above described mechanism. For example, the frame may be supported by one or more eccentric cams drivingly connected to a motor so that, by energizing the motor, the lower rollers can be moved ups and downs.

Although, in the previous embodiment, all of the lower rollers are moved ups and downs, only the upstream or downstream roller may be moved. This can be done in an arrangement in which the frame is supported by two eccentric cams and each of the cams is capable of being driven independently of the other.

Also, it is not necessary to move both of the lower rollers and only the upstream or downstream roller may be moved ups and downs by supporting the frame so as to rotate about the fixed roller.

Further, in the previous embodiment, only the lower rollers are supported to move ups and downs, upper rollers or both upper and lower rollers may be moved ups and downs.

Furthermore, in the previous embodiment, the same number of rollers are arranged on upper and lower sides, though, the number of the upper side may be greater than that of the lower side for providing the upper side of the sheet with more heat, or vice versa.

Moreover, although, in the previous embodiment, each of the rollers includes corresponding heater, only the upper rollers may include heaters, respectively, if the sheet carries the toner image only on the upper surface thereof, or vice versa.

Figure 9:
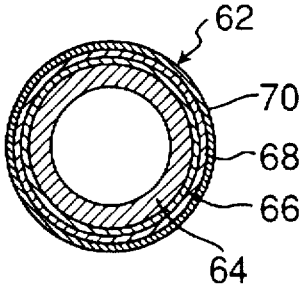
FIG. 9 is a sectional view of a heat roller preferably for use in the invention.

Further, the roller may be a heat roller 62 shown in FIG. 9 in which a cylindrical metal member 64 bears on its peripheral surface an insulating layer 66, a resistance heating layer 68, and a release layer 70 in order. With this roller 62, the surface temperature of the roller 62 can be changed instantaneously by the change of the voltage to be applied to the heat resisting layer 68, which enables the surface of the roller 62 to be heated to the desired temperature immediately after the heat has been taken away therefrom.

Furthermore, the fixing device 20 may be applied to a toner fixing in which the toner image is fixed onto a cut sheet having a distinct length in the sheet feeing direction. For this purpose, each of the rollers should be drivingly connected with the motor 65 and the suitable guide means should be arranged adjacent the lower outer surface portions of the upper rollers and the upper outer surface portions of the lower rollers, respectively, for supplying the sheet from one roller to the subsequent roller.

Moreover, although, in the previous descriptions, the words "upper" and "lower" designate upward and downward directions of respective drawings, each fixing device may be inclined or turned one-fourth revolution. That is, for example, the rollers may be arrayed vertically in zigzag so that the sheet is transported upward or downward.

What is claimed is:

1. A fixing device for heating and then fixing a toner image onto a sheet substrate, comprising:

a first roller;

a second roller spaced apart from said first roller;

a third roller arranged between said first and second rollers with a portion thereof protruded across an imaginary line which contacts with outer peripheries of said first and second rollers on the same side thereof into a region in which said first and second rollers are located;

a fourth roller spaced apart from said third roller beyond said first or second roller with a portion thereof protruded across said imaginary line into said region; and a heat source for heating at least one of said four rollers;

wherein said sheet is transported with one surface thereof contacted with said first and second rollers while the other surface thereof contacted with said third and fourth rollers along a sheet path defined by peripheral portions of said four rollers.

2. A fixing device claimed in claim 1, further comprising:

a first endless belt rotatably supported about said first and second rollers; and a second endless belt rotatably supported about said third and fourth rollers in circumferential contact with said first belt to form a sheet path therebetween;

wherein said sheet is transported with one surface thereof being contacted with said first belt and with the other surface thereof contacted with said second belt along said sheet path.

3. A fixing device claimed in claim 1, further comprising a device which controls the amount of protrusions of said third and fourth rollers across said imaginary line.

4. A fixing device claimed in claim 1, wherein each of said four rollers includes said heat source.

5. A fixing device claimed in claim 1, wherein each of said four rollers are made of metal.

6. A fixing device for heating and then fixing a toner image onto a sheet substrate, comprising:

a first roller;

a second roller spaced apart from said first roller;

a third roller arranged between said first and second rollers with a portion thereof protruded across an imaginary line which contacts with outer peripheries of said first and second rollers on the same side thereof into a region in which said first and second rollers are located; and a heat source for heating at least one of said three rollers;

wherein said sheet is transported with one surface thereof contacted with said first and second rollers while the other surface thereof contacted with said third roller along a sheet path defined by peripheral portions of said three rollers.

7. A fixing device claimed in claim 6, further comprising a device which controls the amount of protrusion of said third roller across said imaginary line.

8. A fixing device claimed in claim 6, wherein each of said three rollers includes said heat source.

9. A fixing device claimed in claim 6, wherein each of said three rollers are made of metal.

10. A fixing device for heating and then fixing a toner image onto a sheet substrate, comprising:

a first endless belt rotatably supported about a first and a second rollers;

a second endless belt rotatably supported about a third and a fourth rollers in circumferential contact with said first belt to form a sheet path therewith, said third roller being arranged between said first and second rollers, and said fourth roller being spaced apart from said third roller beyond said first or second roller; and a heat source for heating at least one of said first and second belt;

wherein said sheet is transported with one surface thereof contacted with said first belt and with the other surface thereof contacted with said second belt along said sheet path.

11. A fixing device claimed in claim 10, wherein said four rollers are so arranged that said first or second roller forces said second belt inwardly while said third or fourth roller forces said first belt inwardly.

12. A fixing device claimed in claim 11, further comprising a fifth roller for supporting said first belt with said first and second rollers; and a sixth roller for supporting said second belt with said third and fourth rollers;

wherein each of said first and second belts includes therein a plurality of perforations along opposite circumferential edges thereof at equal intervals and said fifth and sixth rollers have sprockets, respectively, which engage with said perforations of said first and second belts, respectively.

* * * * *